US006106166A

United States Patent [19]

Spurr et al.

[11] Patent Number: 6,106,166

[45] Date of Patent: Aug. 22, 2000

[54] PHOTOPROCESSING APPARATUS FOR SENSING TYPE OF PHOTOPROCESSING CONSUMABLE AND METHOD OF ASSEMBLING THE APPARATUS

[75] Inventors: Robert W. Spurr, Rochester; Timothy J. Tredwell, Fairport; Lynn D. Dann, Bloomfield; Arthur A. Whitfield, Rochester, all of N.Y.

[73] Assignee: Eastman Kodak Company, Rochester, N.Y.

[21] Appl. No.: 09/292,859

[22] Filed: Apr. 16, 1999

[51] Int. Cl.[7] ..... G03D 13/00; G03D 3/02

[52] U.S. Cl. ..... 396/578; 396/626

[58] Field of Search ..... 396/568–570, 396/578, 626, 632; 399/7–10, 50, 25; 347/7, 14, 19, 86

[56] References Cited

U.S. PATENT DOCUMENTS

| | | | |
|---|---|---|---|
| 4,806,958 | 2/1989 | Momot et al. | 396/208 |
| 5,398,257 | 3/1995 | Groenteman | 399/8 |
| 5,559,578 | 9/1996 | Umeda et al. | 399/50 |
| 5,610,635 | 3/1997 | Murray et al. | 347/7 |
| 5,673,106 | 9/1997 | Thompson | 399/9 |
| 5,812,156 | 9/1998 | Bullock et al. | 347/19 |
| 5,835,817 | 11/1998 | Bullock et al. | 399/25 |
| 5,860,363 | 1/1999 | Childers et al. | 347/7 |

FOREIGN PATENT DOCUMENTS

| | | |
|---|---|---|
| 0 873 873 A2 | 12/1997 | European Pat. Off. . |
| 98/52762 | 11/1998 | WIPO . |

*Primary Examiner*—D. Rutledge
*Attorney, Agent, or Firm*—Walter S. Stevens

[57] ABSTRACT

A photoprocessing apparatus for sensing type of photoprocessing consumable and method of assembling the apparatus. The invention includes a photographic printing and developing apparatus (10) adapted to allow the apparatus to sense types of supplied consumable photosensitive paper and photoprocessing chemicals and method for assembling the consumable paper and chemicals for sensing. An electrically programmable read/write memory contained in a transponder (54) is integrally attached to the consumable paper or chemicals package. The transponder (54) is capable of receiving a first, RF frequency electromagnetic field and deriving power and address information from the first frequency, then generating a second RF frequency electromagnetic field in response, where the second electromagnetic field is characteristic of the data stored in memory. A transceiver (50) is disposed within the photographic printing and developing apparatus (10) with antenna (56) and support components for polling each transponder (54). As instructed by a control logic processor (14), transceiver (50) can both read manufacturing data from the transponder (54) about the consumable paper or chemical and write usage and processing data to the transponder (54) for storage in memory.

52 Claims, 11 Drawing Sheets

PHOTOPROCESSING APPARATUS FOR SENSING TYPE OF PHOTOPROCESSING CONSUMABLE AND METHOD OF ASSEMBLING THE APPARATUS

CROSS REFERENCE TO RELATED APPLICATIONS

This application is related to the following commonly assigned co-pending U.S. applications: "A PRINTER WITH MEDIA SUPPLY SPOOL ADAPTED TO SENSE TYPE OF MEDIA, AND METHOD OF ASSEMBLING SAME", Ser. No. 09/133,114, filed Aug. 12, 1998 (Attorney docket # 78236); and "A PRINTER WITH DONOR AND RECEIVER MEDIA SUPPLY TRAYS EACH ADAPTED TO ALLOW A PRINTER TO SENSE TYPE OF MEDIA THEREIN, AND METHOD OF ASSEMBLING THE PRINTER AND TRAYS", Ser. No. 09/218,595, filed Dec. 22, 1998 (Attorney docket #78365); and "A PRINTER MEDIA SUPPLY SPOOL ADAPTED TO ALLOW THE PRINTER TO SENSE TYPE OF MEDIA, AND METHOD OF ASSEMBLING SAME", Ser No. 09/133,122, filed Aug. 12, 1998 (Attorney docket #78253).

FIELD OF THE INVENTION

This invention generally relates to printing and developing apparatus that process and consume photographic paper and chemicals for paper and/or film processing and more particularly relates to a photoprocessing apparatus for sensing type of consumable paper and chemicals to be loaded into the apparatus and method of assembling the apparatus.

BACKGROUND OF THE INVENTION

Apparatus used for automating development and printing of photographic materials include a widely known type of apparatus generally referred to as a "minilab" and similar equipment. By using these automated devices, retail and wholesale film developers develop photographic film and process prints in a well-controlled process environment that assures quality prints for their customers. Minilab types range from small, low-volume retail units to medium- and high-volume equipment used by major photo retailers.

In addition to minilab systems, this invention also relates to other types of photoprocessing equipment. These can include high-volume photoprocessing systems such as the "Gretag CLAS 35 System" manufactured by Gretag AG located in Regensdorf, Switzerland that makes photographic prints from negatives using optical exposure methods. Additionally, this invention relates to other high-volume photoprocessing systems that use digital printing technologies instead of traditional optical methods for exposing photosensitive paper. As used herein, the terminology "photoprocessing", also known as "photofinishing", includes but is not limited to the entire process whereby a consumer image source (e.g., exposed roll of film) is printed onto a viewable medium such as photographic paper, with steps which may include film developing, printing and paper processing. Digital technologies employed for exposure of photosensitive paper in photoprocessing applications include, but are not limited to the following, which supply exposure energy in digitized form:

- Laser printing, which typically employs one or more lasers;
- CRT printing, which employs one or more scanning electron beams;
- L.E.D. printing, which employs one or more focused Light-Emitting Diodes.

In addition to photoprocessing systems, this invention also relates to digital printers that are not directly used for photoprocessing, but expose images onto photosensitive paper. One such system is the "KODAK LED DIGITAL COLOR PRINTER 20P" manufactured by Eastman Kodak Company located in Rochester N.Y. This printer creates, on photosensitive, silver-halide-based paper, high-quality color images from a digital image source.

Other related equipment to which the present invention may be applied also includes apparatus configured to develop film negatives or slides or apparatus configured to expose prints onto photosensitive paper.

As the above description indicates, the present invention has application to an imaging apparatus that exposes photosensitive paper or consumes photoprocessing chemicals. The description that follows describes the present invention primarily as used with minilab apparatus; however, it is to be understood that the methods disclosed in this specification can be applied more broadly to include the above recited other types of photoprocessing apparatus, printers, developers, and other apparatus.

For printing, minilab operation is fairly straightforward and follows the general sequence described here. The minilab exposes the photographic image from developed film onto photosensitive paper. (It should be noted, from the above discussion, that optical exposure is only one exposure method. Digital minilabs can use other means for providing controlled exposure energy, such as lasers, CRT writers, or LEDs.) Then, the apparatus routes the exposed paper through a sequence of chemical baths in which the image is developed, fixed, and stabilized onto the paper. The consumable items of interest for this invention are both the photosensitive paper that is fed into the minilab and the photoprocessing chemicals that are mixed with water in the chemical baths to provide proper solutions for developing a print or negative.

Other non-minilab apparatus noted above perform, with variations, one or more similar operations as described for minilabs. For example, a digital printer as described above may perform only an exposure operation, whereby the photosensitive paper is exposed, to be subsequently developed on other equipment. For such equipment, processing takes place by feeding new, unexposed photosensitive paper from a feed roll, exposing the paper, then wrapping the exposed paper about a take-up roll, for development at a later time.

Necessarily, the consumables (photosensitive paper and photoprocessing chemicals) used in the minilab are manufactured to high quality standards, with sensitometry and other variables maintained to within tight tolerances. Included in the tolerance considerations are margins for unknown variables at minilab sites. That is, worst-case conditions must be assumed when assessing consumables quality, because the manufacturer cannot know the specific type of minilab system into which the consumable will be loaded. Similarly, the manufacturer cannot predict batch interactions where, for example, a specific batch of photosensitive paper manufactured today could be processed using a specific batch of chemicals manufactured several months previously. Batch-to-batch variations are known to exist, particularly with color film, photosensitive color paper, and chemicals. Today, manufacturers are constrained to tight tolerances and higher costs due, in part, to such worst-case requirements. At the same time, a significant amount of testing is routinely performed on each batch of consumable manufactured, both for paper and for photoprocessing chemicals. Detailed information about each batch, if it were available, could be used to optimize the performance of equipment using these consumables.

The owner of the minilab or other photoprocessing apparatus pays close attention to image quality and is encouraged to follow a set of recommended practices for cleanliness, storage, and stock rotation for these consumables. In general, the minilab equipment is designed to make it easy for an operator to load the correct paper for the prints being processed and to provide the photoprocessing chemicals in the proper concentrations.

Notably, because of economic and environmental concerns, it is advantageous for manufacturers of minilabs to provide a high degree of control over the processing operation, including providing as much information as is necessary about process variables in order to obtain the best quality economically and with minimum waste. To facilitate this tight control, many minilabs include front-end computers that act as control processors and provide various sensing and reporting capabilities for the minilab operator. Among example systems that provide this capability are the "Noritsu QSS-2xxx" series minilabs manufactured by Noritsu Koki Company, Ltd. Located in Wakayama, Japan.

Of particular importance for this invention are the methods by which consumable paper and photoprocessing chemicals are packaged. Photosensitive paper for minilab equipment is typically provided in roll form, with the paper provided in specific roll widths, wound around a core, typically of cardboard. The minilab technician preloads the photosensitive paper roll into a light-tight canister, then installs the canister onto the minilab apparatus. With some types of minilabs (for example, the "Noritsu QSS/SM-2xxx" series), the operator also needs to preset a number of mechanical or magnetic switches on the cartridge in order to indicate to the apparatus what width of paper is loaded into the canister. Or, the operator may be required to enter the width manually on a computer screen or other control console. To track information on roll widths and canister contents, operators use a number of schemes, including manually pasting a label onto the loaded canister.

There are a number of alternative methods for loading photoprocessing chemicals in the minilab. For some machines, particularly at large-scale photoprocessing sites, technicians manually mix each batch of each needed chemical type, combining a pre-measured amount of concentrated chemical and water in a tank. Other systems, however, employ packaged chemicals in some form, whether liquid or pelletized. Here, the packaged chemical is installed within the minilab itself. For such systems, the minilab equipment itself performs the pumping and mixing operations, pumping from the packaged chemical (or extracting a pellet) as needed to maintain bath solutions at the proper concentrations.

"KODAK EKTACOLOR SM Chemicals" manufactured by the Eastman Kodak Company are one example of liquid chemical especially packaged for use in minilab apparatus. The overall method of packaging for concentrated photoprocessing chemicals in this series of products is as described in U.S. Pat. No. 5,694,991 (Harris et al.)

U.S. Pat. No. 5,754,915 (Masuda, et al.) discloses an alternative pelletized system for photoprocessing chemicals. Here, the minilab technician loads a container of pellets onto the machine, with the pellets organized into individual compartments for each chemical type.

It would be advantageous for a minilab to be able to access information automatically from the consumable media itself. Data such as batch number, date of manufacture, emulsion type (for photosensitive paper) and other application-specific information could be used to facilitate handling and processing of the consumable paper or chemical.

As noted above, the consumables manufactured for minilab processing are tested and characterized for performance within certain tolerances. Information on each batch could be used by the minilab's computer processor to optimize system performance. Conventional methods for entering identifying batch information, however, present significant drawbacks. The following methods are employed with various photoprocessing apparatus:

Manual entry via keyboard. Manual entry of batch number data is error-prone and could be easily ignored by a hurried technician. Manual entry does not adequately solve problems of continuously tracking the amount of consumable used. For example, paper could be replaced temporarily with a different roll, or chemicals might be removed during cleaning.

Bar code labeling. Providing a bar code on consumable packaging is another option, but requires multiple readers disposed within the apparatus, one for each consumable package. Light-sensitivity restricts the practical uses of bar-code reading for photographic paper.

Embedded trace patterns. As disclosed in International Publication Number WO 98/52762 (Purcell, et al.), specific trace patterns could be used to identify a consumable type. However, this type of data encoding is fairly inflexible with respect to data storage and provides very little information.

International Publication Number WO 98/52762 discloses an inkjet printer that uses, among a number of other sensors for environmental conditions and consumables status, an RF ID tag device as a means for identifying the type of paper that is loaded in an inkjet printer. This approach offers the advantage of contactless communication with a read/write memory that is added to the inkjet roll. This implementation uses only a single RF ID tag component, limited to the receiver medium in an inkjet printer. In limited inkjet printer environments, only a small amount of information is needed about the media, as is disclosed in WO 98/52762. In the implementation disclosed in WO 98/52762, moreover, introduction of new media could require an update to existing components, for example, to upgrade firmware circuitry if batch information indicated that alternate processing was required for the new media.

Memory circuit. U.S. Pat. No. 5,610,635 (Murray, et al.) discloses enclosing a read/write memory circuit as part of an ink jet cartridge. Using this arrangement, information can be accessed from the cartridge as well as written to the cartridge. Thus, for example, a cartridge can be coded with a print count that gives an indication of how much ink is left in the device. Use of the memory circuit as disclosed in U.S. Pat. No. 5,610,635 could have advantages for use with photoprocessing consumables; however, the need for added interconnect and support circuitry makes use of such a circuit somewhat expensive and places demands on connector hardware reliability.

Additionally, implementing solutions such as are disclosed in U.S. Patent No. 5,610,635 would require substantial retrofit for existing apparatus in the field.

It can be seen from the above background description that there is a need for an automated method for obtaining and maintaining detailed data from photographic paper and photoprocessing chemicals used in an automated photoprocessing apparatus.

SUMMARY OF THE INVENTION

It is an object of the present invention to provide a photoprocessing apparatus and method of sensing type of consumable photosensitive paper and chemicals to be loaded into the apparatus.

According to an aspect of the present invention, the invention resides in a photoprocessing apparatus adapted to sense photoprocessing data associated with a photoprocessing consumable to be loaded therein, comprising a transceiver spaced-apart from the consumable for transmitting a first electromagnetic field and for sensing a second electromagnetic field; and a transponder with a memory associated with the consumable, said memory having data stored therein indicative of type of consumable, said transponder capable of receiving the first electromagnetic field and generating a second electromagnetic field in response to the first electromagnetic field received thereby, the second electromagnetic field being sensed by said transceiver and characteristic of the data stored in said memory.

According to an embodiment of the present invention, a photographic developing apparatus includes a supply spool for photosensitive paper, which is adapted to provide information about the photosensitive paper wound thereon, includes a non-volatile memory, such as an EEPROM (Electrically Erasable Programmable Read-Only Memory) semiconductor component integrally contained in a transponder. Stored in the EEPROM are encoded data indicative of manufacture and performance attributes of the roll of photosensitive paper that is wound about the supply spool. Similarly, a supply package containing photoprocessing chemicals is loaded in a photographic developing apparatus and is adapted to provide information to the apparatus about the enclosed chemicals, again using a non-volatile memory, such as an EEPROM component integrally contained in a transponder. Each transponder is capable of receiving a first electromagnetic field generated by a radio frequency transceiver unit. Each transponder provides power to its semiconductor circuitry as the transponder receives the first electromagnetic field. When the transponder circuitry is powered, the component generates a second electromagnetic field in response to the first electromagnetic field. The second electromagnetic field contains data about the consumable item. The radio frequency transceiver unit senses the second electromagnetic field and extracts the data content for processing by a control logic processing unit that operates the photographic developing apparatus.

A feature of the present invention is the provision of a radio frequency transceiver capable of transmitting a first electromagnetic field to be intercepted by a transponder having data stored therein indicative of the consumable, the transponder capable of generating a second electromagnetic field to be sensed by the radio frequency transceiver.

A further feature of the present invention is the ability of the radio frequency transceiver to address a specific transponder component and write data to that component, where the data written is indicative of usage of a photoprocessing consumable.

It is an advantage of the present invention that it obviates the need for operator entry of data describing the photoprocessing consumable. Instead, this invention provides information to the operator about the photoprocessing consumable that is loaded in the apparatus.

It is a further advantage of the present invention that it allows control logic in a photographic developing apparatus to determine the type of consumable that is loaded and related data about the consumable, such as manufacturing date, batch number, and chemical type, and to record on the memory circuitry that is provided with that consumable useful data on usage and other information for processing.

It is a further advantage of the present invention that it accesses data without requiring that electrical contacts be made to corresponding contacts mounted on consumable packaging.

It is a further advantage of the present invention that it allows backward-compatibility with existing packaging designs for consumables. Consumables provided with transponder components can be used in older apparatus that may not be equipped with the necessary transceiver and logic circuitry that enable use and management of consumables data. No significant alteration of external packaging is necessary to implement this invention.

It is a further advantage of the present invention that it allows calibration data, sensitometry data, and other detailed performance information about the consumable to be stored and provided as part of the consumables packaging, so that detailed information is integrally attached to the consumable. Thus, when a consumable item is transferred between two different apparatus, for example, usage information is retained.

It is a further advantage of the present invention that it allows a way to determine how much consumable photosensitive paper is available which does not compromise the "light-tight" environment needed for photosensitive paper.

It is a further advantage of the present invention that it allows the apparatus to adapt to interacting consumables loaded therein, so that photographic paper from a known batch can be processed optimally when used with consumable chemicals from a known batch.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

For the description that follows, the general term "consumable" is used to comprehend photosensitive paper, film, and any photoprocessing chemicals that are loaded into a photoprocessing, photographic developing, or printing apparatus.

Figure 1:
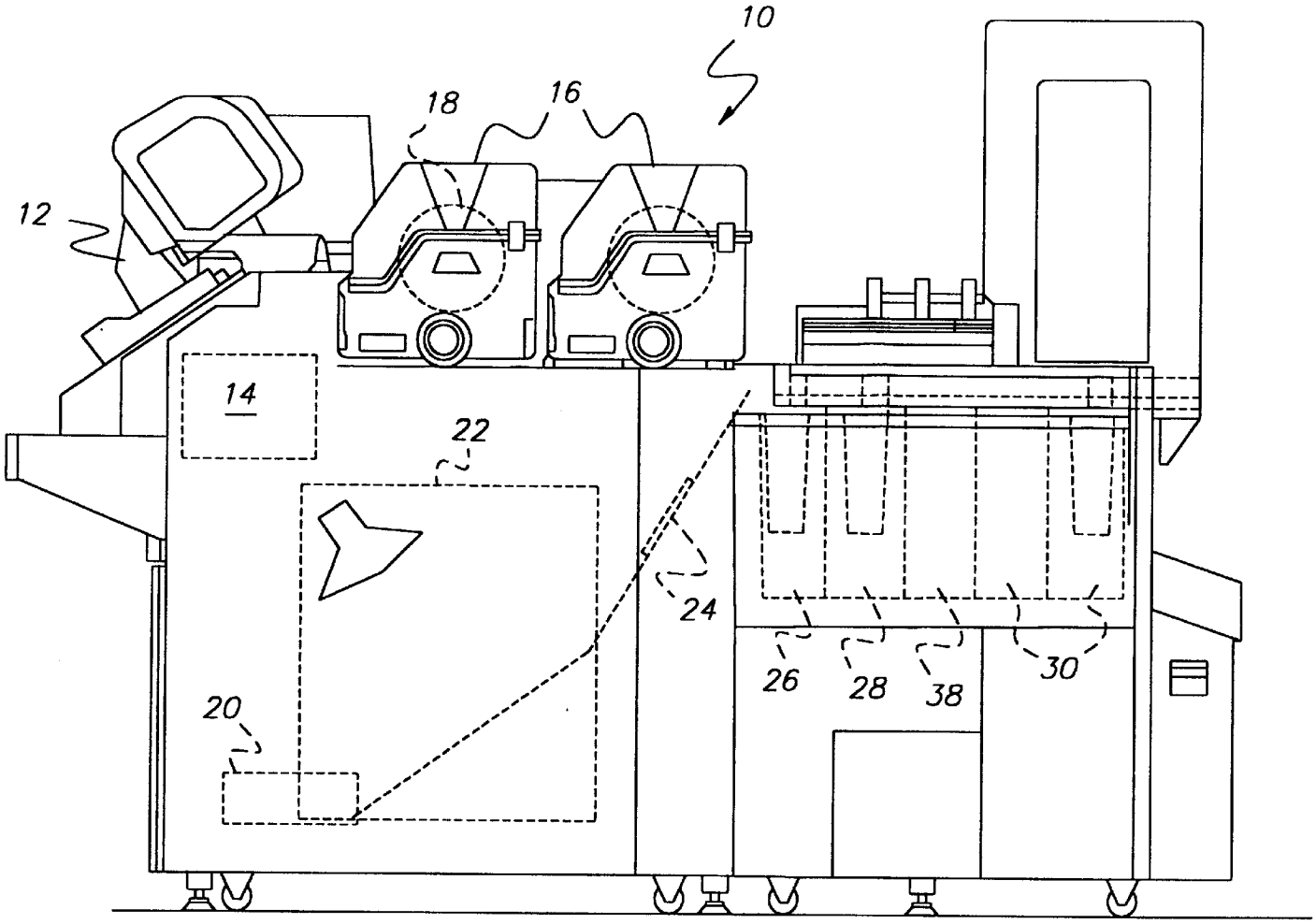
FIG. 1 (PRIOR ART)
FIG. 1 is a side view of a prior art photoprocessing system of the minilab type, with the positions of significant internal components represented.

FIG. 1 shows a typical prior art photoprocessing apparatus of the minilab type, generally referred to as 10. Apparatus 10 includes a control console 12, which provides an operator interface to a control logic processor 14 that in turn provides control and reporting functions for photoprocessing apparatus 10. A paper supply cartridge 16 supplies, in roll form, a photosensitive paper 18 (shown dotted in FIG. 1) which is guided to a cutter mechanism 20 and through an exposure section 22 where photosensitive paper 18 is exposed to produce the photographic print. An exposed print 24 is then guided through a series of chemical baths in order to develop, fix, and stabilize the image. For a typical apparatus of this type, exposed print 24 is first routed through a developer tank 26. Next, exposed print 24 is routed through a bleach tank 28 and through a fixer tank 38. Then, exposed print 24 is routed through one or more stabilizer tanks 30. Finally, exposed print 24 typically goes to a drying rack (not shown) from which the finished photographic print is retrieved.

Figure 2:
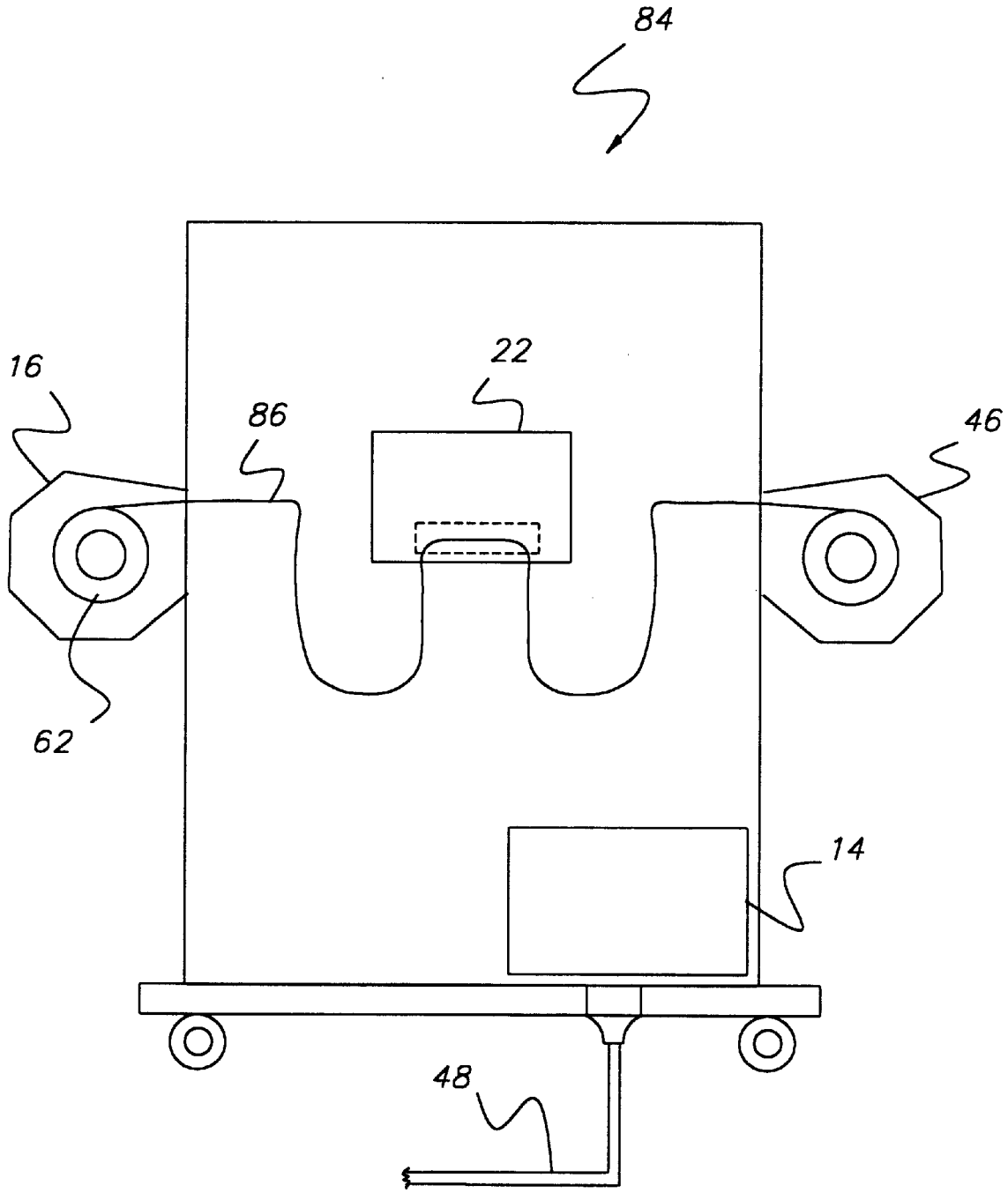
FIG. 2 (PRIOR ART)
FIG. 2 is a schematic side view of a prior art digital printer system used for high-volume photoprocessing, showing the positions of relevant internal components.

Referring to FIGS. 1 and 2, there may be variations as to minilab apparatus type, consumables supply, sequencing, and apparatus layout. The preferred embodiment of the present invention adapts a photoprocessing apparatus, minilab-type 10 as shown in FIG. 1 for consumables sensing. However, the present invention is not limited to minilab apparatus 10. Other types of equipment to which this invention can be applied include a high-volume photoprocessing apparatus 84, as represented in the schematic side view of FIG. 2. The paper path in high-volume photoprocessing apparatus 84 is generally shown numbered 86. In such an apparatus, a paper supply cartridge 16 supplies a roll of photosensitive paper 62 that feeds continuously (un-cut) through an exposure section 22, where the photosensitive paper 62 is exposed in individual frames. The exposed photosensitive paper 62 is then wound back on a paper take-up cartridge 46. A separate apparatus (not shown) is then used to develop the exposed roll of photosensitive paper 62 (using a similar sequence of chemical tanks as are employed in photoprocessing apparatus, minilab type 10 in FIG. 1). To print images, exposure section 22 may employ conventional optical exposure methods, wherein a corresponding roll of negatives (not shown) is routed from a supply (not shown) to a take-up reel (also not shown), generally in parallel with paper path 86, and individual negative frames are then optically exposed in sequence. Alternately, exposure section 22 may employ laser, LED, CRT, or other sources for exposure energy using digital image data. This digital image data, provided by a host computer (not shown) connected by means of a cable 48, typically originates on a separate scanner apparatus that scans the film negatives and stores scan data. This digital image data can also be provided by a digital source such as from a digital camera, a KODAK PICTURE CD, or from a data file. A control logic processor 14 receives the image data, communicates the image data to exposure section 22, and controls and monitors the overall operation of high-volume photoprocessing apparatus 84.

Figure 3:
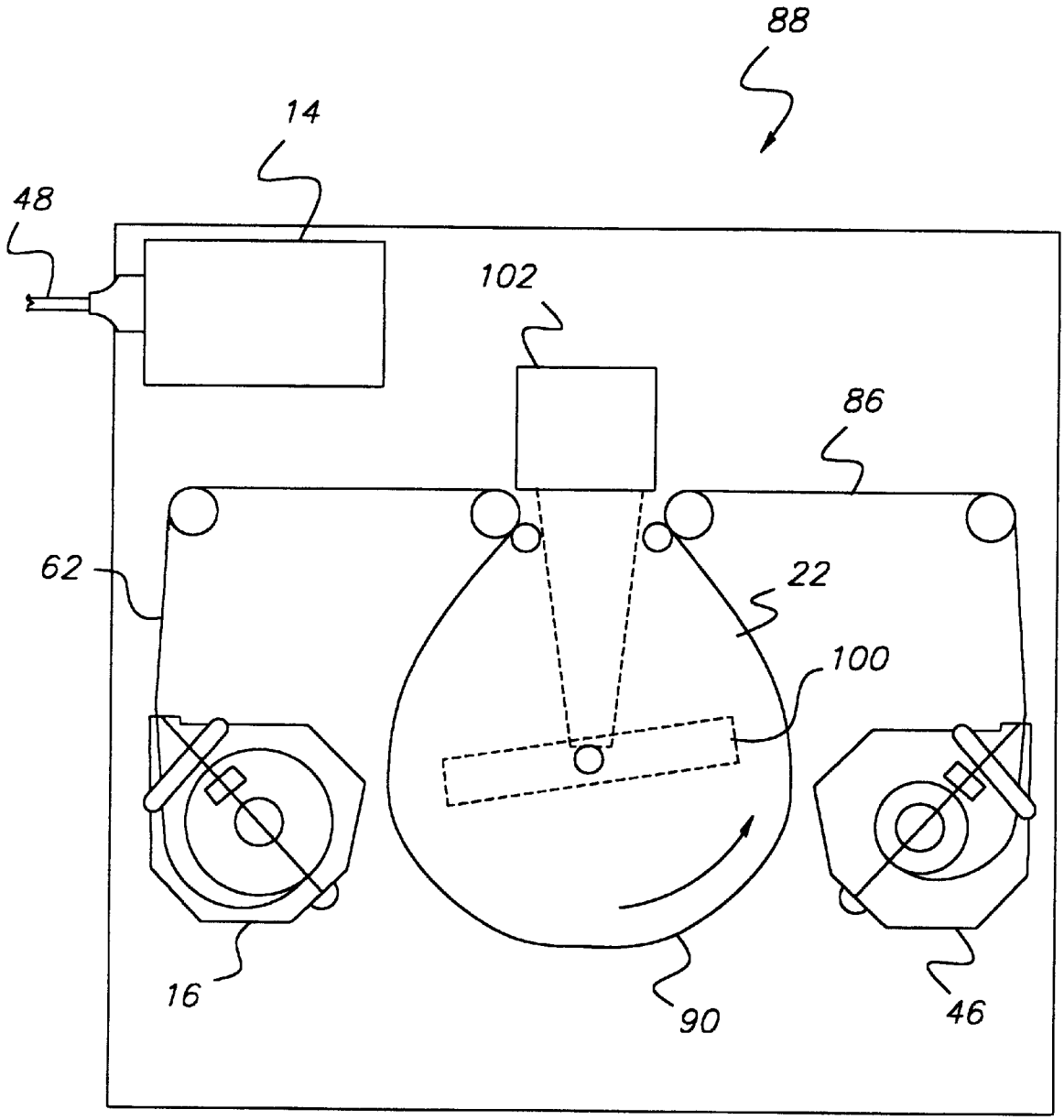
FIG. 3 (PRIOR ART)
FIG. 3 is a schematic side view of a prior art digital printer system used for high-quality imaging on photosensitive paper showing the positions of relevant internal components.

FIG. 3 shows yet another apparatus to which the present invention can be applied. A digital printer, generally shown as number 88, again comprises both a paper supply cartridge 16 and a paper take-up cartridge 46. The paper path, generally shown numbered 86, winds into an internal drum 90 in exposure section 22. A printhead 100 rotates in the direction of the arrow shown and, guided by a translation system 102, translates along the axis of drum 90 to expose the photosensitive paper 62. Digital data, provided by a cable 48 that connects to a host computer (not shown) goes to a control logic processor 14 for delivery to printhead 100.

As FIGS. 1, 2, and 3, which show various types of prior art apparatus to which the present invention can be applied, share similar structures and have similar requirements for handling consumable photoprocessing paper. The present invention can be used with such photoprocessing or printing apparatus that in turn use consumable photosensitive paper in roll or pre-packaged form as well as apparatus that use photoprocessing chemicals in a pre-packaged form.

Handling of photosensitive paper and associated data

As was noted above, photosensitive paper 18 is most often provided in roll form. For photoprocessing apparatus, minilab type 10, the roll width is sized for standard photographic print sizes, so that one apparatus 10 may have more than one paper supply cartridge 16 loaded and available for use at one time. It should be emphasized that while roll form is used in the preferred embodiment of this invention, it is possible to apply the method of this invention to photosensitive paper 18 provided in sheet form.

It is useful to note the following about photosensitive paper 18 as relevant to the present invention:

Light-tightness required. For each type of minilab and printer apparatus described above, a method of loading is used to protect photosensitive paper 18 from light damage (such as in paper supply cartridge 16 described above and as shown in cross-sectional detail in Figs. 10A and 10B) . Necessarily, once the roll of photosensitive paper 18 is loaded in the apparatus, the level of supply (that is, how much paper is left on the roll) is not visible to the operator.

Batch data, emulsion data, and date of manufacture of the roll of photosensitive paper 18 are available. Such data, if provided to control logic processor 14, could be used to optimize the development process.

There is data associated with the exposed roll that is provided in paper take-up cartridge 46 as output by the types of photoprocessing and printing apparatus shown in FIGS. 2 and 3. Information from the system that exposed the roll, as well as manufacturing information transferred directly from the supply to the take-up roll, can be used to optimize subsequent development processing of the roll on another system.

Handling of photoprocessing chemicals and associated data

Photoprocessing chemicals may be manually mixed on some photoprocessing apparatus, minilab type 10, as described above. However, there are a number of such apparatus that use pre-packaged chemicals. As it relates to photoprocessing chemicals, this invention is directed to those types of apparatus where photoprocessing chemicals are provided in some prepackaged form.

Figure 4B:
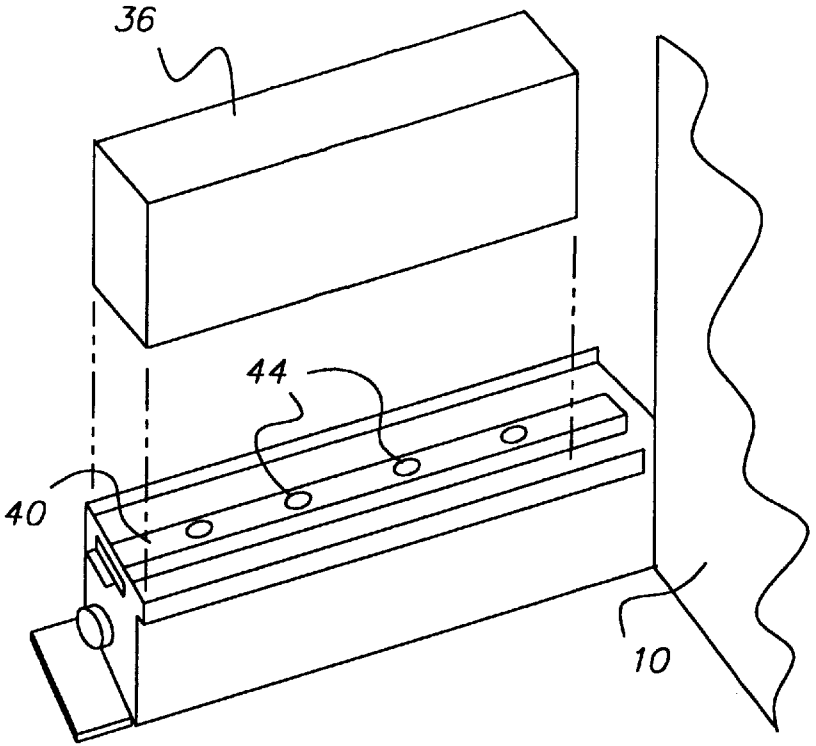
FIG. 4B (PRIOR ART)
FIGS. 4A and 4B are views in perspective of the prior art packaging arrangement and loading orientation used for "KODAK EKTACOLOR SM Chemicals"
Figure 4A:
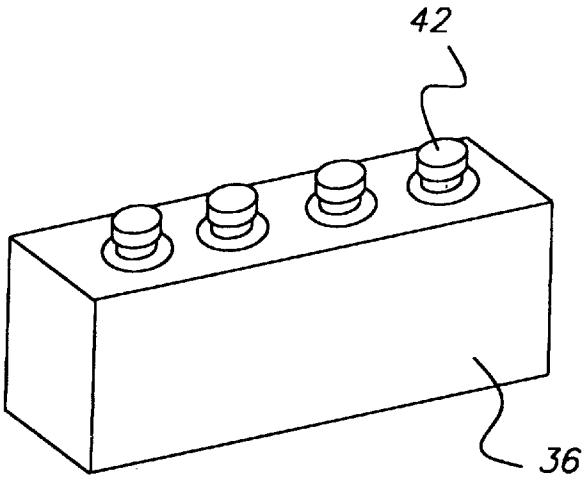
FIG. 4A (PRIOR ART)

FIGS. 4A and 4B show the prior art arrangement used for "KODAK EKTACOLOR SM Chemicals", used with minilabs. Here, photoprocessing chemicals, in concentrated liquid form, are loaded into apparatus 10 for mixing directly in apparatus 10 itself. In the arrangement used for SM Chemicals, a box 36 holds a number of plastic containers 42. Box 36 is positioned in place onto a rack 40 that extends (for loading) from the chassis of apparatus 10, with valve components 44 provided by rack 40 hardware (as disclosed in U.S. Pat. No. 5,694,991).

Figure 5:
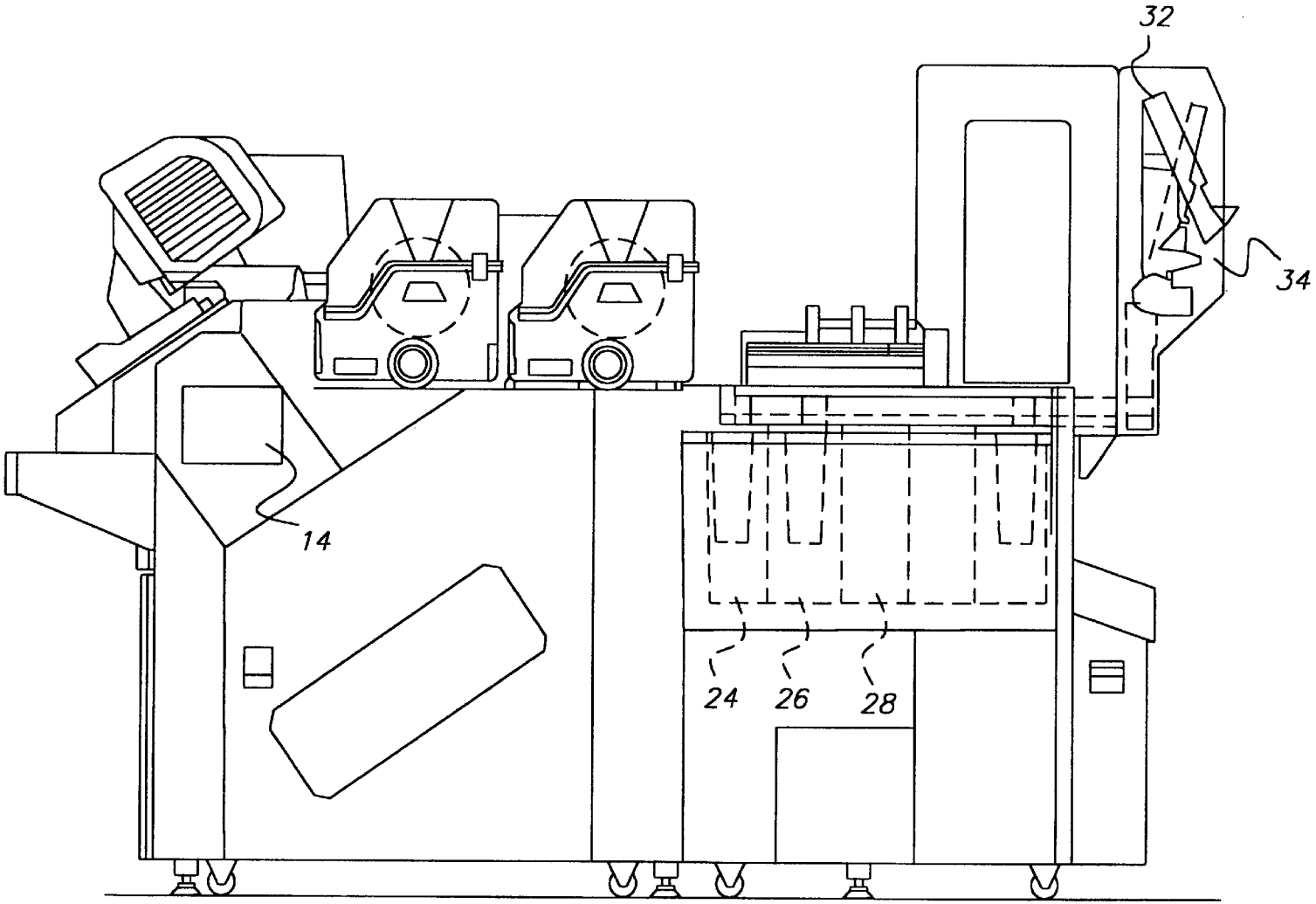
FIG. 5 (PRIOR ART)
FIG. 5 is a side view of a prior art photoprocessing system of the minilab type that is adapted to accept pellets for chemical replenishment.

FIG. 5 shows an alternate type of prior art apparatus where photoprocessing chemicals are provided as pellets, as is disclosed in U.S. Pat. No. 5,754,915 (Masuda, et al.). Here, a pellet cartridge 32 is installed in a pellet loader 34. Under control of control logic processor 14, pellet loader 34 automatically feeds an appropriate pellet from pellet cartridge 32 into a mixing tank on the apparatus, where pellet cartridge 32 is dissolved and the resulting solution is used to replenish one of tanks 24, 26, or 28.

Useful information concerning these photoprocessing chemicals may include date of manufacture, manufacturer name, batch numbers, and concentration, among other data.

Adapting the Photoprocessing Apparatus for Consumables Sensing

Figure 6:
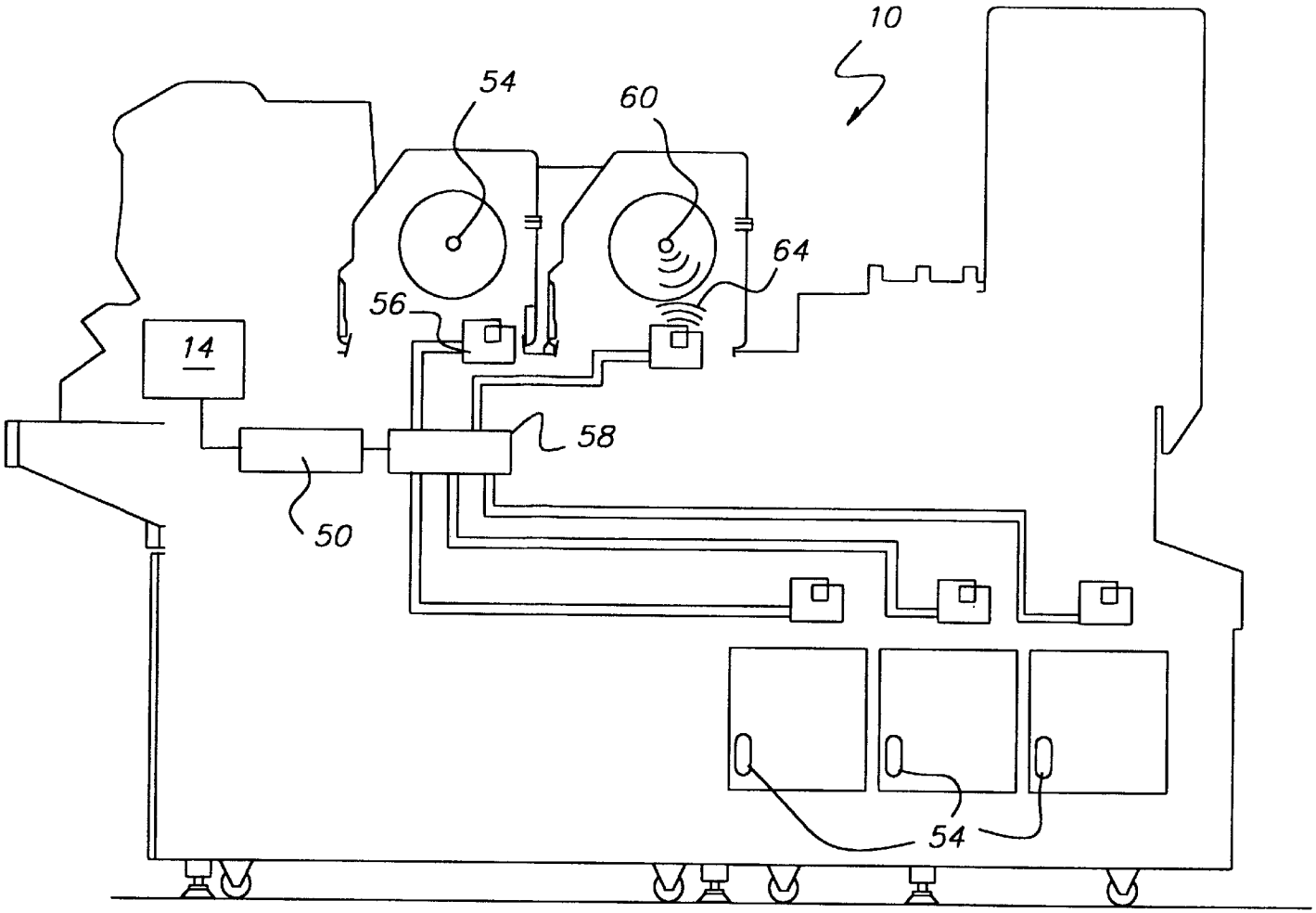
FIG. 6 is a schematic representation that shows a photoprocessing system that is adapted for sensing consumables using the present invention.

FIG. 6 shows schematically how photoprocessing apparatus, minilab type 10 is adapted for sensing consumable photosensitive paper and photoprocessing chemicals. An RF transceiver 50 is connected to control logic processor 14 internal to apparatus 10. Such a transceiver 50 may be a "Model S2000" transceiver, available from Texas Instruments, Incorporated, located in Dallas, Tex., USA. Alternatively, transceiver 50 may use a "Model U2270B" transceiver, available from Vishay-Telefunken Semiconductors, Incorporated, located in Malvern, Pennsylvania, USA. Transceiver 50 connects, via a multiplexing switch 58, to an antenna 56 located at each of a plurality of locations, with one antenna 56 for each consumable item to be sensed.

In operation, transceiver 50 is capable of transmitting a first electromagnetic field 64 of a first predetermined frequency, for reasons disclosed presently. Transceiver 50 is also capable of receiving a second electromagnetic field 66 of a second predetermined frequency, for reasons disclosed presently. Typically, the same frequency serves for both first and second electromagnetic fields 64 and 66.

An RF transponder 54 is integrally connected to each consumable item, as part of the consumable package, as disclosed momentarily. Each transponder 54 can be an "SAMPT" (Selective Addressable Multi-Page Transponder), part number "RI-TRP-IR2B" available from Texas Instruments, Incorporated. Alternatively, each transponder 54 may be a "Model TL5550" transponder, available from Vishay-Telefunken Semiconductors, Incorporated.

RF transponders of the type used in the present invention are low-power devices that derive their source power from the first electromagnetic field 64 emitted by transceiver 50. This allows transponders of this type to be housed in a very small package (in the preferred embodiment, transponder 54 is generally cylindrical, smaller than 4 mm in diameter and less than 32 mm in length).

As FIG. 6 illustrates, transceiver 50 communicates, via a separate antenna 56, with each of a number of transponders 54. Transceiver 50 polls a single transponder 54 at a time using one of a number of possible multiplexing schemes. In the preferred embodiment, multiplexing switch 58, using techniques and components well-known in the art, makes the electrical connection between a specific antenna 56 and transceiver 50 in order to poll a specific transponder 54. Alternate mechanisms for polling individual transponders 54 include use of a plurality of microreader modules (such as a "RI-STU-MRDl Micro-reader" from Texas Instruments, Inc.) Using this scheme, a microreader module, connected to control logic processor 14, would be disposed within apparatus 10 near the location of each transponder 54.

Transceiver 50 is electrically coupled to control logic processor 14, by means of a standard interface (such as, for example, RS-232C serial connection). This connection, in conjunction with the polling mechanism described above, allows control logic processor 14 to control the operation of transceiver 50 so that it can successively poll individual transponders 54 that correspond to each consumable that is currently loaded in photoprocessing apparatus 10, in order to access information from each transponder 54.

As FIG. 6 shows, communication via antenna 56 between transceiver 50 and transponders 54 can take place over a limited distance. This allows transceiver 50 to be mounted or placed within the photoprocessing apparatus 10 at a convenient location, allowing retrofit of transceiver 50, along with multiplexing switch 58 and antennas 56, to upgrade existing equipment.

Adapting Related Apparatus for Consumables Sensing

Figure 7:
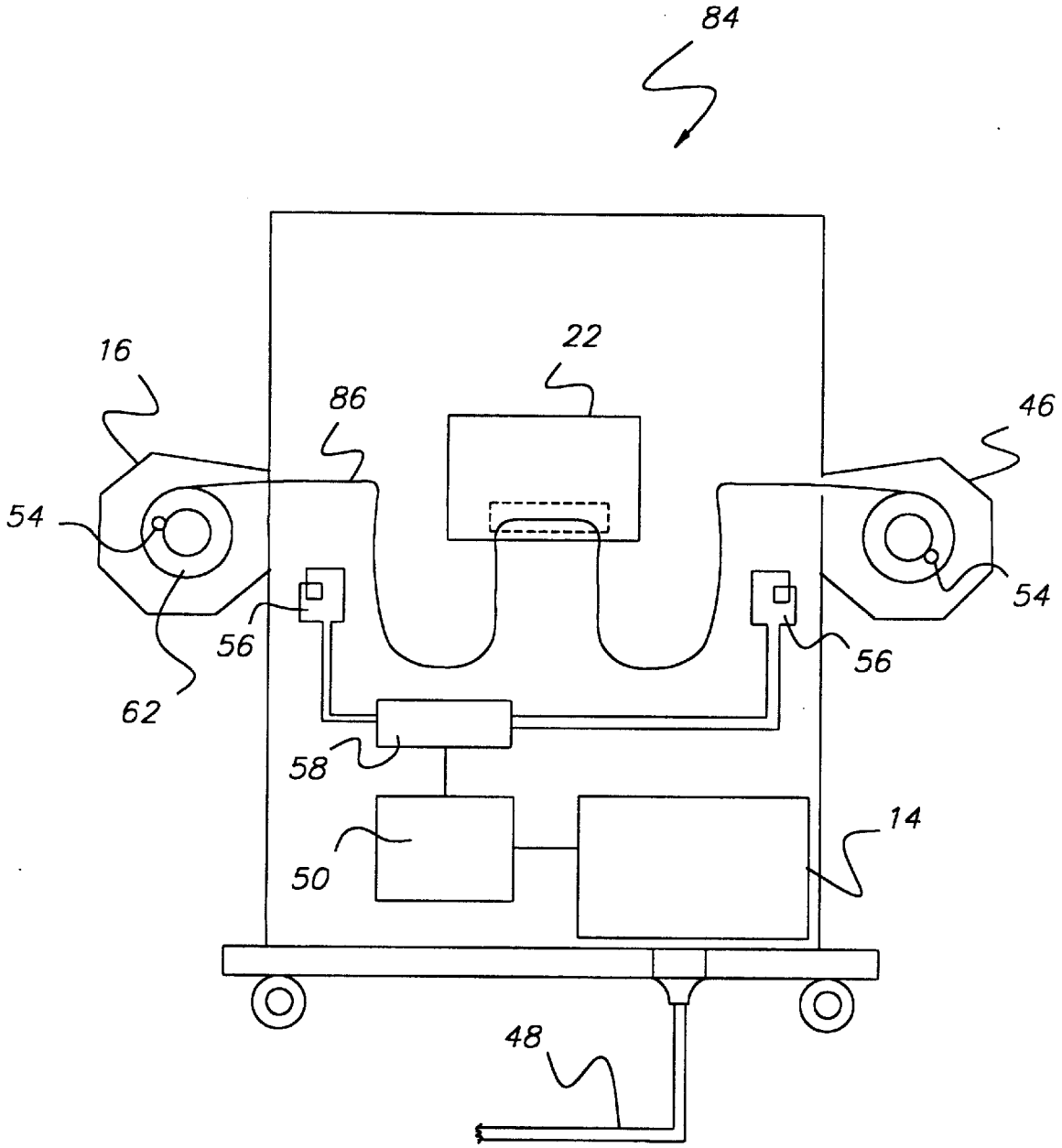
FIG. 7 is a schematic side view that shows a digital printer system used for high-volume photoprocessing that is adapted for sensing consumables using the present invention.

FIG. 7 shows schematically how a high-volume photoprocessing apparatus 84 is adapted for sensing consumable photosensitive paper. Here, a transponder 54 is disposed within paper supply cartridge 16 and another transponder 54 is disposed within paper take-up cartridge 46. Transceiver 50 communicates with either cartridge 16 or 46 via the appropriate antenna 56. As described above, the polling scheme employs either multiplexing switch 58 (the preferred embodiment) or a microreader module.

Figure 8:
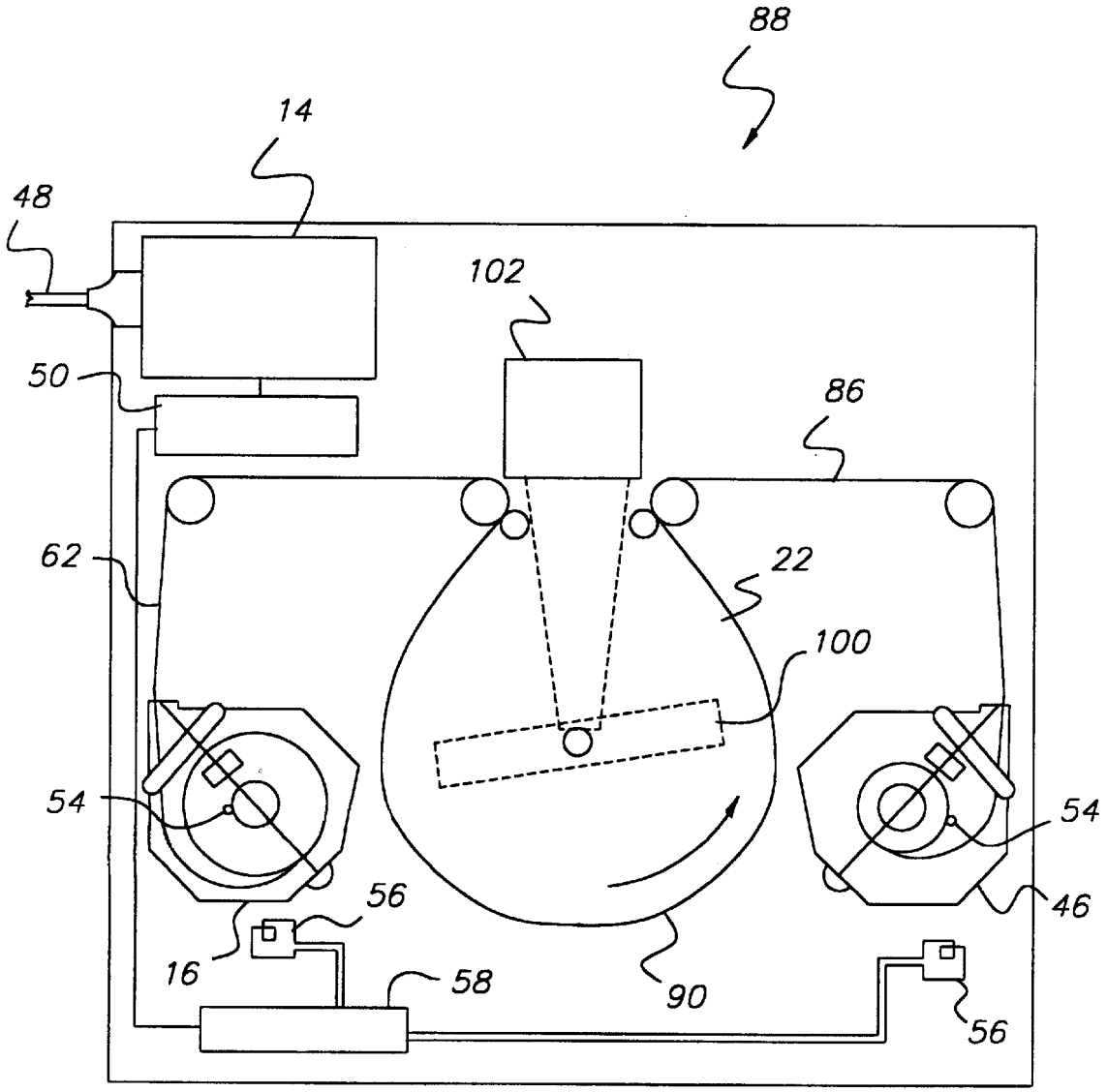
FIG. 8 is a schematic side view that shows a digital printer system used for high-quality imaging on photosensitive paper that is adapted for sensing consumables using the present invention.

FIG. 8 shows schematically how digital printer 88 is adapted for sensing consumable paper, using parallel transceiver 50, antenna 56, multiplexing switch 58 and transponder 54 components.

Transceiver 50 Communication with Transponders 54

It is instructive to note how transceiver 50 communicates with transponder 54, disposed at a location within photoprocessing apparatus 10 (or related photoprocessing apparatus 84 or printer 88). Transponder 54 is tuned to the RF carrier frequency emitted by transceiver 50. Upon receiving an initial RF signal from transceiver 50, transponder 54 circuitry obtains, from the emitted electromagnetic energy, sufficient energy to provide source voltage for its internal circuitry. Thus, no battery is needed to separately power transponder 54.

Each transponder 54 is individually programmed with an unique identifying address code (ID). As a final stage in manufacture, transponder 54 is programmed to store its ID along with other data that is characteristic of the consumable material. In the preferred embodiment, transponder 54 is assembled with the consumable, but does not require programming until final assembly stages. This obviates the need to track a consumable with its corresponding transponder 54 during manufacture.

Transceiver 50 has both read and write access to transponder 54 memory data. As will be described subsequently, this allows transponder 54 to store useful information on actual usage in addition to its stored information on manufacture.

To communicate with an individual transponder 54, transceiver 50 encodes the unique identifying address code as part of its emitted signal, along with a command to read data from or to write data to ("program") transponder 54. Transponder 54 responds to transceiver 50 communication only when it has been addressed correctly. This mechanism allows transceiver 50 to specifically address an individual transponder 54 and helps to avoid interference signals from a nearby transponder 54 that might be accidentally activated by the received signal from transceiver 50.

In addition to selective addressing, there are other data security options available with the SAMPT device used for transponder 54 in the preferred embodiment. Individual memory blocks or "pages" can be separately locked to prevent inadvertent overwriting of stored data. Commands are available to allow access to individual pages only, so that transceiver 50 can be permitted to read or write only specific data from transponder 54.

Adapting Photosensitive Paper for Sensing

Figure 9:
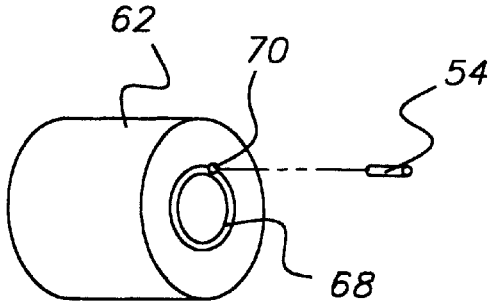
FIG. 9 is a view in perspective of a roll of photosensitive paper adapted for sensing consumables using an integrally packaged transponder component.

Photosensitive paper for minilab and other photoprocessing apparatus is typically provided in roll form. FIG. 9 shows a roll of photosensitive paper 62 adapted for sensing. Here, a transponder 54 is fitted, during manufacture, into a pre-drilled hole 70 in core 68.

Figure 10A:
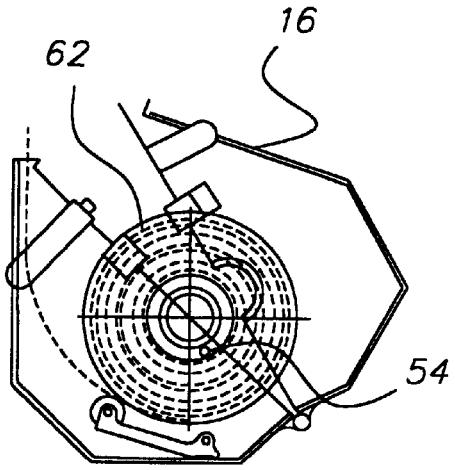
FIGS. 10A and 10B show a paper supply cartridge as used with a minilab, printer, or similar imaging apparatus.
Figure 10B:
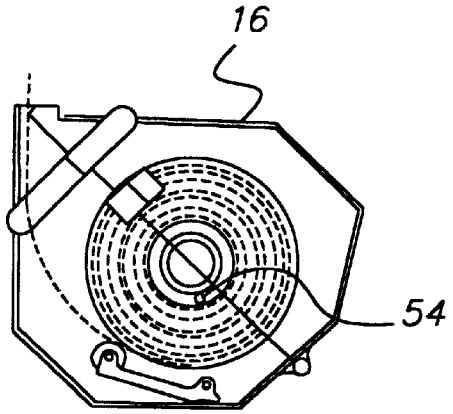

FIGS. 10A and 10B illustrate the placement of the roll of photosensitive paper 62 within paper cartridge 16. Loading of paper supply cartridge 16 is performed under darkroom conditions. This complicates the task of determining how much unexposed photosensitive paper 62 remains on paper supply cartridge 16 or how much exposed photosensitive paper 62 is wound within paper take-up cartridge 46.

However, it should be noted that the method shown in FIG. 9 for attaching transponder 54 to roll of photosensitive paper 62 for consumables sensing is backward-compatible. That is, a roll of photosensitive paper 62 adapted as shown in FIG. 5 will be usable in an existing photoprocessing apparatus 10 or 84 or digital printer 88 that is not adapted for consumables sensing as was shown in FIGS. 6, 7, or 8. Other methods could be used for attaching transponder 54. Backward-compatibility allows the same roll design to continue to serve customers with older equipment while providing the advantages of consumables sensing for customers having newer or upgraded equipment.

For use with high-volume photoprocessing apparatus 84 or digital printer 88, an empty take-up roll (not shown) is also provided with a transponder 54. Referring to FIG. 9, the empty take-up roll consists of a core 68. In the same manner as with a roll of photosensitive paper 62, a pre-drilled hole 70 provides a cavity for transponder 54 in an empty take-up roll. It may be appreciated that transponder 54 in an empty take-up roll is initially programmed with minimal identifying information only, since the apparatus that performs the exposure will write usage and other data.

Adapting the Photoprocessing Chemical Package for Sensing

Figure 11B:
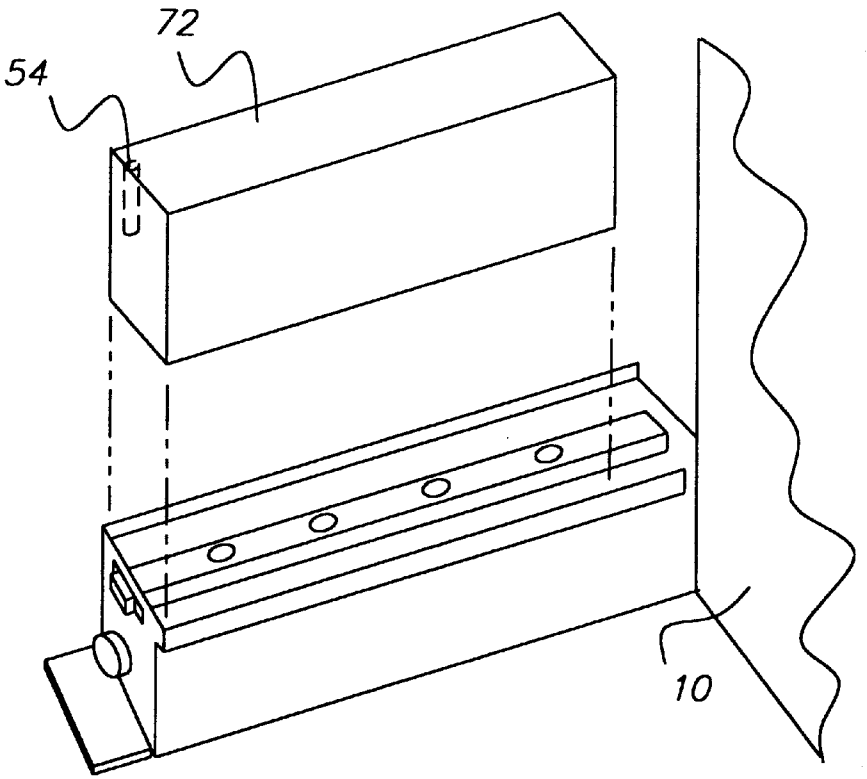
FIGS. 11A and 11B are views in perspective showing use of a transponder component disposed within existing "KODAK EKTACOLOR SM Chemicals" packaging.
Figure 11A:
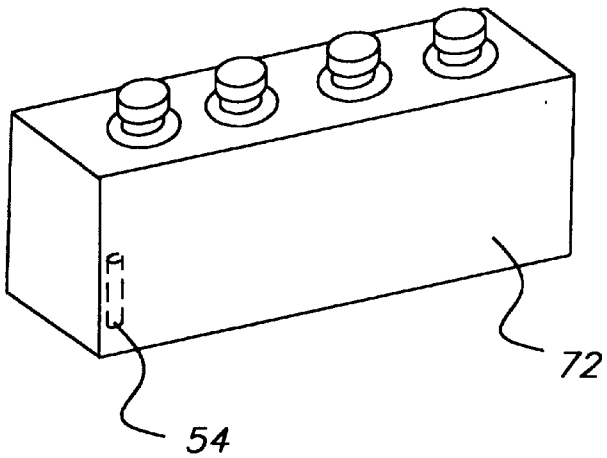

FIGS. 11A and 11B show how the SM package for photoprocessing chemicals, described earlier, is adapted for consumables sensing by transceiver 50 in the preferred embodiment. Transponder 54 is fitted into outer box 72 when manufactured. However, it may be appreciated that the actual position of transponder 54 within outer box 72 may vary from that shown. In the preferred embodiment, tape is used to hold transponder 54 securely in place. A small amount of glue could alternately be employed.

Figure 12A:
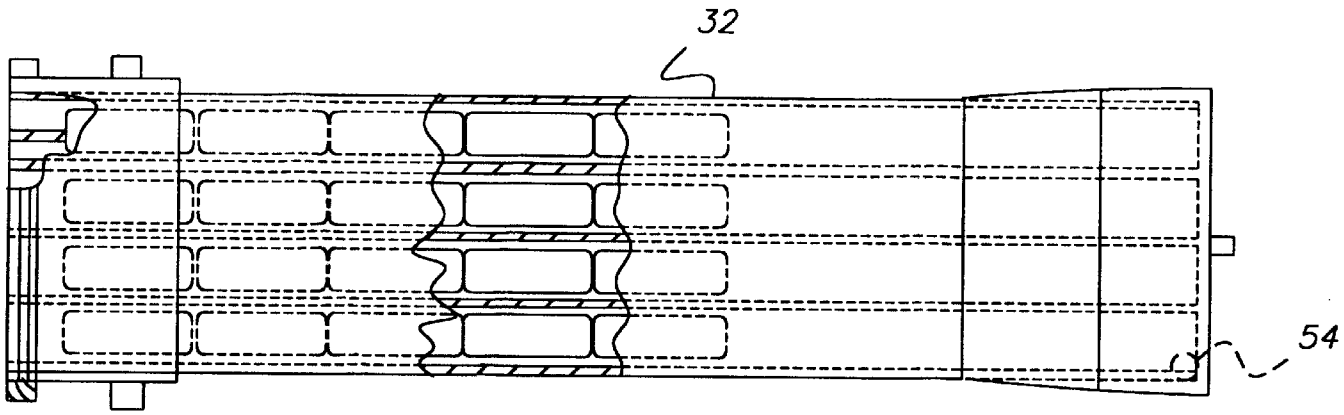
FIGS. 12A and 12B are top and side views, respectively, showing a transponder component disposed within existing pellet cartridge packaging.
Figure 12B:
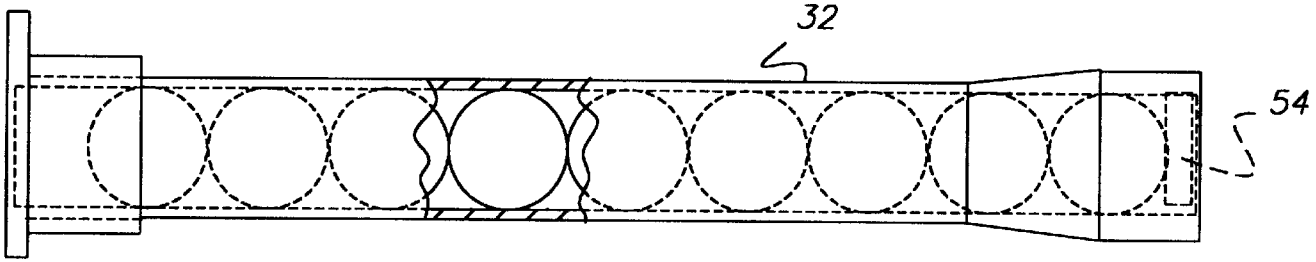

FIGS. 12A and 12B show an alternate embodiment of the invention, wherein transponder 54 is fitted into pellet cartridge 32. Here, transponder 54 could be held in place by tape or glue or other suitable means of attachment.

It should be noted that the embodiments shown in FIGS. 11A, 11B, 12A, and 12B allow backward compatibility, advantageous for the same reasons indicated for photosensitive paper, noted above.

Tracking Consumables Types and Optimizing Usage

The placement of hardware components described above, disposed within photoprocessing apparatus 10 and within the packaging provided for photosensitive paper and consumable photoprocessing chemicals provides the structure needed to support access to, and maintenance of, consumables data.

Control logic processor 14 stores information received from each transponder 54 when polled. At regular intervals, such as after each operation of photoprocessing apparatus 10, control logic processor 14 again polls any or each of transponders 54 in order to update its stored information or to write usage data to the non-volatile memory (e.g., EEPROM) storage on transponder 54 for any consumable.

Data stored on the non-volatile memory (e.g., EEPROM)

By way of example only, and not by way of limitation, the data stored in transponder 54 that is installed in an unexposed roll of photosensitive paper 62 may be any of the exemplary data displayed in Table 1 hereinbelow.

TABLE 1

Data Stored in Transponder 54 for Unexposed Roll of Photosensitive Paper 62

| Data Stored | Number of Bits | Description |
|---|---|---|
| Consumable Type Identifier | 8 | An 8-bit number encoding the type of consumable. |
| Product Code | 40 | 10-digit product code. (May not be required if Consumable Type Identifier provides enough data.) |
| Catalog Number | 32 | For example, TG 4745. |
| Manufacture Date | 16 | 16-bit encoded date. Includes 4-bit month, 5-bit day, 7-bit year components. |
| Batch Emulsion Data | 128 | Includes encoded batch number, sensitivity and response data from testing of samples, density benchmark data, sensitometry data obtained for the batch. |
| Sensitometric Data | 128 | Parameter values allowing characterization of sensitometric response for this paper, including exposure/density reciprocity characteristics for each exposure source (such as optical, LED, laser) that could be used with this paper type. |
| Roll length | 16 | 16-bit encoded data on length of roll of photosensitive paper 62 |
| Roll width | 16 | 16-bit encoded data on width of roll of photosensitive paper 62 |
| Frame Counter | 16 | 16-bit counter recording how many prints have been made from the roll. |

Note from Table 1 that control logic processor 14 has access to a sizable amount of manufacturing data on roll of photosensitive paper 62. In addition, control logic processor 14 also writes data to transponder 54 on roll of photosensitive paper 62 that indicates how many prints have been made from roll 62. Because roll 62 may be removed from a first apparatus 10 temporarily (for example, to generate prints having a different paper width), it is particularly advantageous to record information on print usage where this usage information is stored within roll 62 itself. Thus, for example, the same roll 62 could be placed on a second apparatus 10 at the same site without loss of usage information. This is especially advantageous for photosensitive paper, since light-tightness must be observed. This is important because an operator can not easily view the roll to see how much photosensitive paper remains.

As noted in Table 1, other information recorded for rolls of photosensitive paper 62 includes data on variables applied in photoprocessing apparatus 10 in order to optimize print quality.

By way of example only, and not by way of limitation, the data stored in transponder 54 that is installed within a package of photoprocessing developer chemicals may be any of the exemplary data displayed in Table 2 hereinbelow.

TABLE 2

Data Stored in Transponder 54 for Photoprocessing Developer

| Data Stored | Number of Bits | Description |
|---|---|---|
| Consumable Type Identifier | 8 | An 8-bit number encoding the type of consumable. |
| Product Code | 40 | 10-digit product code. (May not be required if Consumable Type Identifier provides enough data.) |
| Catalog Number | 32 | For example, TD 8672. |
| Manufacture Date | 16 | 16-bit encoded date. Includes 4-bit month, 5-bit day, 7-bit year components. |
| Test Data | 128 | Values from manufacturing testing, including specific values on formulation; impurities, and related data. |
| Frame Counter | 16 | 16-bit counter recording how many prints remaining (or, alternately, have been made) using this container of chemical solution. Alternately, this counter could indicate the amount of developer concentrate removed from this container. |

By way of example only, and not by way of limitation, the data stored in transponder 54 that is installed within a take-up roll of photosensitive paper used with a high-volume photoprocessing apparatus that provides a separate exposure unit may be any of the exemplary data displayed in Table 3 hereinbelow.

TABLE 3

Data Stored in Transponder 54 for Photosensitive Paper in High-Volume Photoprocessing Apparatus 84 on Paper Take-up Cartridge 46

| Data Stored | Number of Bits | Description |
|---|---|---|
| Consumable Type Identifier | 8 | An 8-bit number encoding the type of consumable. |
| Product Code | 40 | 10-digit product code. (May not be required if Consumable Type Identifier provides enough data.) |
| Catalog Number | 32 | For example, TD 8672. |
| Manufacture Date | 16 | 16-bit encoded date. Includes 4-bit month, 5-bit day, 7-bit year components. |

TABLE 3-continued

Data Stored in Transponder 54 for Photosensitive Paper in High-Volume Photoprocessing Apparatus 84 on Paper Take-up Cartridge 46

| Data Stored | Number of Bits | Description |
|---|---|---|
| Batch Emulsion Data | 128 | Includes encoded batch number, sensitivity and response data from testing of samples, density benchmark data, sensitometry data obtained for the batch. |
| Sensitometric Data | 128 | Parameter values allowing characterization of sensitometric response for this paper, including exposure/density reciprocity characteristics for each exposure source (such as optical, LED, laser) that could be used with this paper type. Copied from transponder 54 in paper supply cartridge 16. |
| Exposure Data | 128 | Specific values on exposure conditions, including exposure energy source (laser, CRT, LED, optical), energy level, and wavelength. |
| Length | 16 | 16-bit encoded data on length of paper in paper take-up cartridge 46. |
| Dates of Exposure | 32 | 32-bit encoded dates indicating when exposure began and ended for the roll in paper take-up cartridge 46. |
| Defect Data | 16 | 16-bit encoded data listing any defective or unusable frames or indicating length of unexposed header or trailer section. |
| Frame Counter | 16 | 16-bit counter recording how many prints remain (or, alternately, have been made) on this roll. |
| Job ID | 16 | 16-bit encoded data that identifies the job contents for order tracking within the photoprocessing facility. |

As Table 3 indicates, data originating from transponder 54 in paper supply cartridge 16 can be copied to the roll in paper take-up cartridge 46. In this way, the original manufacturing data travels with the exposed paper as this paper is subsequently processed.

Tables 1, 2, and 3 above are intended as illustrative examples only. The actual arrangement of memory data is a factor of memory size (memory capacity of EEPROM devices can be expected to expand over the next few years) and is a factor of the data required to optimize processing by the photoprocessing apparatus.

It should be noted that the data listed in Tables 1, 2, and 3 refer to the corresponding consumables only; this information is in addition to identification and security information stored on each transponder 54. Each transponder 54 is programmed with a unique ID, stored on the non-volatile memory (e.g., EEPROM), that assures that one transponder 54 can be recognized from another. In addition, write capability (that is, programming of EEPROM values by transceiver 50) is password-protected. A password, also stored in non-volatile memory (e.g., EEPROM), assures that usage values can only be written from transceiver 50 that is installed within photoprocessing apparatus 10 (or high-volume photoprocessing apparatus 84 or digital printer 88).

Response to Stored Data by Photoprocessing Apparatus 10

Response of the photoprocessing apparatus 10 to stored memory data for each consumable can include color balance correction, such as adjustments to timing for specific operations. For example: control logic processor 14 polls transponder 54 for roll of photosensitive paper 62. The data returned from transponder 54 includes emulsion data for roll of photosensitive paper 62. The specific values in this data indicate variability in density response for photosensitive paper 62, where a different (i.e., more or less) exposure time may be recommended. In response, control logic processor 14 alters the exposure time to compensate for the values received. High-volume photoprocessing apparatus 84 and digital printer 88 respond with exposure adjustments in similar fashion.

As a further example, developing speed with which apparatus 10 routes exposed print 24 through developer tank 26, bleach tank 28, and fixer tank 38 may be slowed or speeded up, based on sensed manufacturing date of the corresponding photoprocessing chemicals.

Overall, the processing changes performed by photoprocessing apparatus 10 (or high-volume photoprocessing apparatus 84 or digital printer 88) based on sensed consumables data would be determined by the control logic program that executes in control logic processor 14.

Significantly, the present invention does not require dimensional or structural changes to existing consumables packaging. As described above and illustrated in FIGS. 11 A, 11B, 12A, and 12B, transponder 54 can be inserted into existing packaging arrangements without any changes to the mechanical interface for the consumables in photoprocessing apparatus 10 (or high-volume photoprocessing apparatus 84 or digital printer 88). Therefore, an existing photoprocessing apparatus 10 (or high-volume photoprocessing apparatus 84 or digital printer 88) can use consumables that are adapted for this invention as described above, even where the existing apparatus has not been upgraded to include the addition of transceiver 50. In contrast, an upgraded photoprocessing apparatus 10 (or high-volume photoprocessing apparatus 84 or digital printer 88) can take advantage of the additional data provided by the present invention to optimize photoprocessing.

Referring again to FIG. 6, it is shown that the present invention enables photoprocessing apparatus 10 to adjust its operation with respect to multiple variables. Not only does control logic processor 14 have access to specific data on the characteristics of the photosensitive paper that is loaded, at the same time, control logic processor 14 also has access to specific data on the characteristics of the photoprocessing chemicals with which a print from that photosensitive paper will be developed. This means that control logic processor 14 can adjust photoprocessing apparatus timing and exposure parameters to compensate for the interaction of these consumables. That is, given accurate data on batch formulation and manufacturing data for these consumables, it is possible to predict how a specific roll of photosensitive paper 62 interacts with specific photoprocessing chemicals. With this data, control logic processor 14 can adapt the timing and exposure operations of photoprocessing apparatus 10 to optimize the photofinishing operation. This gives the benefit of a "system-wide" solution that is new to the minilab and photoprocessing apparatus environment.

Initialization of Consumable When First Loaded

When a new consumable package is first loaded on the apparatus, an initial identification sequence takes place, during which transponder 54 on the newly loaded consumable is initially read and its data stored by control processor 14. This sequence can be operator-initiated, such as by entry of a command on control console 12. Alternately, consumable initialization can be initiated by sensing a mechanical event (such as the closing of a panel on the apparatus or detection of a newly positioned paper supply cartridge 16.)

It may be appreciated from the teachings herein that in a photoprocessing system, such as a "minilab", it is desirable to have transponders in one or more of the consumables. The film chemicals could have one transponder, the paper chemicals a second transponder and the paper a third transponder. This would allow for a more automated means of adapting the minilab hardware to the characteristics of a particular lot of consumables. The data from any one transponder or any combination of transponders may be transferred between the respective transponder and the transceiver. The minilab hardware can read the data from the respective consumables, such as the paper and paper chemicals, and automatically calculate adjustments in system parameters such as exposure time to provide more consistent and high quality prints.

Such a minilab system could require fewer transceivers than transponders; provided, however, that the transceivers range is sufficient to encompass multiple transponders. Since the transponder has a unique identification, it is possible that only one transceiver would be required. This would reduce the hardware cost of the minilab.

It can be appreciated from the teachings above that the present invention offers significant advantages in eliminating manual data entry steps and its concomitant errors; in providing information on consumables usage that persists if the consumable photosensitive paper or photofinishing chemicals are temporarily removed from a specific photoprocessing apparatus; and in providing information that allows optimization of the photofinishing operation with corresponding gains in image quality and customer satisfaction and a decrease in waste. The present invention provides these and other advantages without requiring redesign of consumables packaging and without requiring retrofit of existing apparatus for customers who may not yet be ready to make the minimal investment required to benefit from this invention.

While the invention has been described with particular reference to its preferred embodiments, it will be understood by those skilled in the art that various changes may be made and equivalents may be substituted for elements of the preferred embodiments without departing from the invention. For example, the invention may be used with photoprocessing apparatus other than the minilab, high-volume photofinishing systems, or printer apparatus described herein. The invention allows a wide range of possibilities for including a transponder within the consumables package, not limited to the preferred embodiments outlined herein. The transponder, when appropriately encased, could even be immersed within a photoprocessing chemical in the supply package.

As another example, alternate components and methods could be used to optimize communication between transceiver 50 and transponders 54, including RF amplifiers or use of RF shielding or mechanical articulation of consumables or antenna structures. Data structures, memory component types, and types of data stored may vary significantly from those described here. The transponder could be battery powered or could use some other source of power. These and other attributes of this invention could be altered without departing from the scope and spirit of this invention.

Moreover, it may be understood that the invention can be used monitor inventory by tracking movement of materials (e.g., photographic materials) in and out of storage or through a photoprocessing facility. For example, a plurality of transceivers may be located a fixed location in the floor of the facility and a transponder may be connected to a material being moved. In this manner, signals transmitted between the fixed transceiver and the transponder allow monitoring of movement of the material.

Therefore, what is provided is a photoprocessing apparatus for sensing type of consumable to be loaded in the apparatus and method of assembling the apparatus.

PARTS LIST

10. Photoprocessing apparatus, minilab type
12. Control console
14. Control logic processor
16. Paper supply cartridge
18. Photosensitive paper
20. Cutter mechanism
22. Exposure section
24. Exposed print
26. Developer tank
28. Bleach tank
30. Stabilizer tank
32. Pellet cartridge
34. Pellet loader
36. Box
38. Fixer tank
40. Rack
42. Plastic containers
44. Valve components
46. Paper take-up cartridge
48. Cable
50. Transceiver
54. Transponder
56. Antenna
58. Multiplexing switch
62. Roll of photosensitive paper
64. First electromagnetic field
66. Second electromagnetic field
68. Core
70. Pre-drilled hole
72. Outer box
80. Communications link
82. Remote computer
84. High-volume photoprocessing apparatus
86. Paperpath
88. Digital printer
90. Drum
100. Printhead
102. Translation system

What is claimed is:

1. A photoprocessing apparatus adapted to sense photoprocessing data associated with a photoprocessing consumable to be loaded therein, comprising:

(a) a transceiver spaced-apart from the consumable for transmitting a first electromagnetic field and for sensing a second electromagnetic field; and (b) a transponder with a memory associated with the consumable, said memory having data stored therein indicative of type of consumable, said transponder capable of receiving the first electromagnetic field and generating a second electromagnetic field in response to the first electromagnetic field received thereby, the second electromagnetic field being sensed by said transceiver and characteristic of the data stored in said memory.

2. The apparatus of claim 1, wherein said transceiver transmits the first electromagnetic field at a predetermined first radio frequency.

3. The apparatus of claim 1, wherein said memory transmits the second electromagnetic field at a predetermined second radio frequency.

4. The apparatus of claim 1, wherein said memory is a read/write memory.

5. The apparatus of claim 1, wherein said memory is coupled to a photosensitive film consumable.

6. The apparatus of claim 1, wherein said memory is coupled to a developer consumable.

7. The apparatus of claim 1, wherein said memory is coupled to a bleach consumable.

8. The apparatus of claim 1, wherein said memory is coupled to a fixer consumable.

9. The apparatus of claim 1, wherein said memory is coupled to the photoprocessing consumable.

10. The apparatus of claim 1, wherein said memory is coupled to a chemical package containing a developer consumable, a bleach consumable, or a fixer consumable.

11. The apparatus of claim 1, wherein said memory is coupled to a photosensitive paper consumable.

12. The apparatus of claim 11, further comprising a take-up member adapted to engage the photosensitive paper consumable for taking-up of the photosensitive paper consumable, said take-up member having said memory integrally attached thereto.

13. The apparatus of claim 12, wherein said take-up member is a spindle.

14. The apparatus of claim 12, wherein said take-up member is a cartridge.

15. The apparatus of claim 1, further comprising an exposure section disposed relative to the consumable for exposing the consumable to produce a photographic print.

16. The apparatus of claim 15, wherein said exposure section comprises an optical exposure device.

17. The apparatus of claim 15, wherein said exposure section comprises an LCD exposure device.

18. The apparatus of claim 15, wherein said exposure section comprises a laser exposure device.

19. The apparatus of claim 15, wherein said exposure section comprises a CRT exposure device.

20. A photoprocessing apparatus adapted to sense photoprocessing data associated with a photoprocessing consumable to be loaded therein, comprising:

(a) a transceiver spaced-apart from the consumable for transmitting a first electromagnetic field and for sensing a second electromagnetic field;

(b) a first transponder with a first memory coupled to a first consumable; and (c) a second transponder with a second memory coupled to a second consumable, each of said first and second memories having data stored therein indicative of type of consumable, so that a selected one of either of said transponders is capable of receiving the first electromagnetic field and generating a second electromagnetic field in response to the first electromagnetic field received thereby, the second electromagnetic field being sensed by said transceiver and characteristic of the data stored in said memory associated with said selected transponder generating the second electromagnetic field.

21. The apparatus of claim 20, wherein the first consumable is a paper consumable and the second consumable is a paper chemicals consumable.

22. The apparatus of claim 20, wherein the first consumable is a paper chemicals consumable and the second consumable is a film chemicals consumable.

23. The apparatus of claim 20, wherein the first consumable is a paper consumable and the second consumable is a film chemicals consumable.

24. The apparatus of claim 20, further comprising a third transponder with a third memory coupled to a third consumable, said third memory having data stored therein indicative of type of consumable.

25. The apparatus of claim 24, wherein the first consumable is a paper consumable, the second consumable is a paper chemicals consumable and the third consumable is a film chemicals consumable.

26. A method of assembling a photoprocessing apparatus adapted to sense photoprocessing data associated with a photoprocessing consumable to be loaded therein, comprising the steps of:

(a) disposing a transceiver spaced-apart from the consumable for transmitting a first electromagnetic field and for sensing a second electromagnetic field; and (b) providing a transponder with a memory associated with the consumable, the memory having data stored therein indicative of type of consumable, the transponder capable of receiving the first electromagnetic field and generating a second electromagnetic field in response to the first electromagnetic field received thereby, the second electromagnetic field being sensed by the transceiver and characteristic of the data stored in the memory.

27. The method of claim 26, wherein the step of disposing a transceiver comprises the step of disposing a transceiver adapted to transmit the first electromagnetic field at a predetermined first radio frequency.

28. The method of claim 26, wherein the step of providing a transponder with a memory comprises the step of providing a transponder with a memory adapted to transmit the second electromagnetic field at a predetermined second radio frequency.

29. The method of claim 26, wherein the step of providing a transponder with a memory comprises the step of providing a transponder with a read/write memory.

30. The method of claim 26, wherein the step of providing a transponder with a memory comprises the step of providing a transponder with a memory coupled to a photosensitive film consumable.

31. The method of claim 26, wherein the step of providing a transponder with a memory comprises the step of providing a transponder with a memory coupled to a developer consumable.

32. The method of claim 26, wherein the step of providing a transponder with a memory comprises the step of providing a transponder with a memory coupled to a bleach consumable.

33. The method of claim 26, wherein the step of providing a transponder with a memory comprises the step of providing a transponder with a memory coupled to a fixer consumable.

34. The method of claim 26, wherein the step of providing a transponder with a memory comprises the step of providing a transponder with a memory coupled to the photoprocessing consumable.

35. The method of claim 26, wherein the step of providing a transponder with a memory comprises the step of providing a transponder with a memory coupled to a chemical package containing a developer consumable, a bleach consumable, or a fixer consumable.

36. The method of claim 26, wherein the step of providing a transponder with a memory comprises the step of providing a transponder with a memory coupled to a photosensitive paper consumable.

37. The method of claim 36, further comprising the step of providing a take-up member adapted to engage the photosensitive paper consumable for taking-up of the photosensitive paper consumable, the take-up member having the memory integrally attached thereto.

38. The method of claim 37, wherein the step of providing a take-up member comprises the step of providing a spindle.

39. The method of claim 37, wherein the step of providing a take-up member comprises the step of providing a cartridge.

40. The method of claim 26, further comprising the step of disposing an exposure section relative to the consumable for exposing the consumable to produce a photographic print.

41. The method of claim 40, wherein the step of disposing an exposure section comprises the step of disposing an optical exposure device.

42. The method of claim 40, wherein the step of disposing an exposure section comprises the step of disposing an LCD exposure device.

43. The method of claim 40, wherein the step of disposing an exposure section comprises the step of disposing a laser exposure device.

44. The method of claim 40, wherein the step of disposing an exposure section comprises the step of disposing a CRT exposure device.

45. A method of assembling a photoprocessing apparatus adapted to sense photoprocessing data associated with a photoprocessing consumable to be loaded therein, comprising the steps of:

(a) disposing a transceiver spaced-apart from the consumable for transmitting a first electromagnetic field and for sensing a second electromagnetic field;

(b) providing a first transponder with a first memory coupled to a first consumable; and (c) providing a second transponder with a second memory coupled to a second consumable, each of the first and second memories having data stored therein indicative of type of consumable, so that a selected one of either of the transponders is capable of receiving the first electromagnetic field and generating a second electromagnetic field in response to the first electromagnetic field received thereby, the second electromagnetic field being sensed by the transceiver and characteristic of the data stored in the memory associated with the selected transponder generating the second electromagnetic field.

46. The method of claim 45, (a) wherein the step of providing a first transponder with a first memory coupled to a first consumable comprises the step of providing a first transponder with the first memory coupled to a paper consumable; and (b) wherein the step of providing a second transponder with a second memory coupled to a second consumable comprises the step of providing a second transponder with the second memory coupled to a paper chemicals consumable.

47. The method of claim 45, (a) wherein the step of providing a first transponder with a first memory coupled to a first consumable comprises the step of providing a first transponder with the first memory coupled to a paper chemicals consumable; and (b) wherein the step of providing a second transponder with a second memory coupled to a second consumable comprises the step of providing a second transponder with the second memory coupled to a film chemicals consumable.

48. The method of claim 45, (a) wherein the step of providing a first transponder with a first memory coupled to a first consumable comprises the step of providing a first transponder with the first memory coupled to a paper consumable; and (b) wherein the step of providing a second transponder with a second memory coupled to a second consumable comprises the step of providing a second transponder with the second memory coupled to a film chemicals consumable.

49. The method of claim 45, further comprising the step of providing a third transponder with a third memory having the data stored therein.

50. The method of claim 49, wherein the first consumable is a paper consumable, the second consumable is a paper chemicals consumable and the third consumable is a film chemicals consumable.

51. In a photoprocessing apparatus that takes, as input, unexposed photosensitive paper on a supply roll that has an attached first memory component and provides, as output, exposed photosensitive paper on a take-up roll that has an attached second memory component, a method of copying data from the attached first memory component to the attached second memory component, comprising the steps of:

(a) reading the data from the first memory component on the supply roll;

(b) transmitting the data read from the first memory; and (b) writing the data to the second memory component on the take-up roll after receiving the transmitted data.

52. The method of claim 51, wherein the first and second memory components are coupled to a first transponder and a second transponder, respectively.

* * * * *